US007513388B2

(12) United States Patent
Maher

(10) Patent No.: US 7,513,388 B2
(45) Date of Patent: Apr. 7, 2009

(54) RETRACTABLE STRAW DEVICE

(76) Inventor: Stephen Maher, 14D Blackrock Road, Randalstown (GB) BT41 3LF ( * ) Notice: Subject to any disclaimer, the term of this patent is extended or adjusted under 35 U.S.C. 154(b) by 299 days.

(21) Appl. No.: 10/556,484

(22) PCT Filed: May 12, 2004

(86) PCT No.: PCT/EP2004/005125

§ 371 (c)(1),
(2), (4) Date: Aug. 10, 2006

(87) PCT Pub. No.: WO2004/101389

PCT Pub. Date: Nov. 25, 2004

(65) Prior Publication Data

US 2007/0108214 A1 May 17, 2007

(30) Foreign Application Priority Data

May 13, 2003 (GB) ..... 0310947.7

(51) Int. Cl.
*A47G 19/22* (2006.01)
*B65D 25/44* (2006.01)
*B65D 47/08* (2006.01)

(52) U.S. Cl. ..... 220/707; 220/709; 220/710.5

(58) Field of Classification Search ..... 220/705, 220/703, 707, 708, 709, 710, 710.5
See application file for complete search history.

(56) References Cited

U.S. PATENT DOCUMENTS 2,194,011 A * 3/1940 Davidson ..... 229/103.1
2,805,809 A 9/1957 Pugh
3,776,458 A * 12/1973 Chunga, Sr. ..... 239/33
4,109,817 A * 8/1978 Payne et al. ..... 220/706
4,190,173 A * 2/1980 Mason et al. ..... 220/203.05
5,253,779 A * 10/1993 Lee ..... 220/705
5,339,982 A 8/1994 Tardie
5,484,080 A * 1/1996 Blasnik et al. ..... 220/708
5,513,762 A 5/1996 Janani
6,129,265 A * 10/2000 Perryman et al. ..... 229/103.1
6,131,763 A * 10/2000 Stanish et al. ..... 220/706
6,371,329 B1 * 4/2002 Wild ..... 220/705
6,375,019 B1 * 4/2002 Hirota et al. ..... 215/229
6,375,032 B1 4/2002 Kim
6,375,092 B1 * 4/2002 Banach ..... 239/33

(Continued)

FOREIGN PATENT DOCUMENTS

WO WO 01/60217 A 8/2001

*Primary Examiner*—Anthony D Stashick
*Assistant Examiner*—Niki M Eloshway
(74) *Attorney, Agent, or Firm*—John W. Ryan, Esq.; Crowell & Moring LLP

(57) ABSTRACT

A device (10) for a drinks container (11), the device comprising a straw (16) and means for actuating the straw (16) between a retracted state, in which the straw (16) is housed, in use, substantially within the container (11), and an extended state, in which at least a portion of the straw (16) protrudes, in use, form the container (11). The actuating means may comprise a first casing (12) provided around a portion of the straw (16), the straw (16) and the casing (12) being rotatable with respect to one another about a longitudinal axis, the actuating means further comprising means for imparting generally linear movement to the straw (16) upon relative rotational movement of the casing and the straw portion.

7 Claims, 7 Drawing Sheets

U.S. PATENT DOCUMENTS 6,427,928 B1 * 8/2002 Hirota et al. ..... 239/33
6,431,382 B1 * 8/2002 Li ..... 215/388
7,204,382 B2 * 4/2007 Cezeaux ..... 215/229
2005/0061822 A1 * 3/2005 Naesje ..... 220/705

* cited by examiner

RETRACTABLE STRAW DEVICE

FIELD OF THE INVENTION

The present invention relates to a device for use with a drinks container, in particular, a retractable straw device.

BACKGROUND TO THE INVENTION

It is known for drinks containers to include a region of pierceable foil through which a straw may be inserted, to enable a user to drink through the straw. However, once the container has been pierced, the contents are liable to spill out if the container is knocked over. When a straw is used to drink from a bottle, and the user wants to re-cap the bottle, the straw must either be removed completely, or pushed down inside the bottle, which can often result in the straw becoming stuck in the bottle.

SUMMARY OF THE INVENTION

Accordingly, a first aspect of the invention provides a device for a drinks container, the device comprising a straw and means for actuating the straw between a retracted state, in which the straw is housed, in use, substantially within the container, and an extended state, in which at least a portion of the straw protrudes, in use, from the container.

In preferred embodiments, the actuating means comprises a first casing provided around a portion of the straw, the straw and the casing being rotatable with respect to one another about a longitudinal axis, the actuating means further comprising means for imparting generally linear movement to the straw upon relative rotational movement of the casing and the straw portion. More preferably, one of the casing and the straw portion is associated with one or more can surfaces, the other of the casing and the straw portion being associated with one or more cam followers.

Advantageously, the actuating means includes a second casing provided around said portion of the straw and between said straw portion and said first casing, the first and second casings being rotatable with respect to one another about a longitudinal axis, the second casing being shaped to define a slot in which the or each cam follower rides. In the preferred mode of use, rotation of the second casing causes rotation of the straw with respect to the first casing thereby actuating the straw towards the extended or retracted states depending on the direction of rotation.

Conveniently, the second casing includes a handle portion which projects beyond the first casing in the general direction in which the straw is movable towards the extended state. Advantageously, handle portion comprises a cap for blocking the straw when in the retracted state.

In one embodiment, the straw carries one or more cam followers in the form of one or more lugs and the first casing comprises one or more cam surfaces in the form of a generally helical track.

In one embodiment, the device is carried by a lid for the container, the arrangement being such that, when the lid is fitted to the container, the device is seated in the mouth of the container. Such a device is suitable for retro-fitting to a conventional container, for example a beverage can. The lid may be adapted for press-fit engagement with the end of the container that includes the container mouth.

From a second aspect, the invention provides a container comprising the device of the first aspect of the invention.

Further advantageous aspects of the invention will become apparent to those ordinarily skilled in the art upon review of the following description of preferred embodiments of the invention and with reference to the accompanying description.

As used herein, the term "container" is used to mean any container suitable for holding a fluid, and especially a liquid or beverage, including cans, bottles, cartons, and any other suitable receptacle.

BRIEF DESCRIPTION OF THE DRAWINGS

Embodiments of the invention will now be described by way of example and with reference to the accompanying drawings in which like numerals are used to indicate like parts and in which.

DETAILED DESCRIPTION OF THE DRAWINGS

Figure 1:
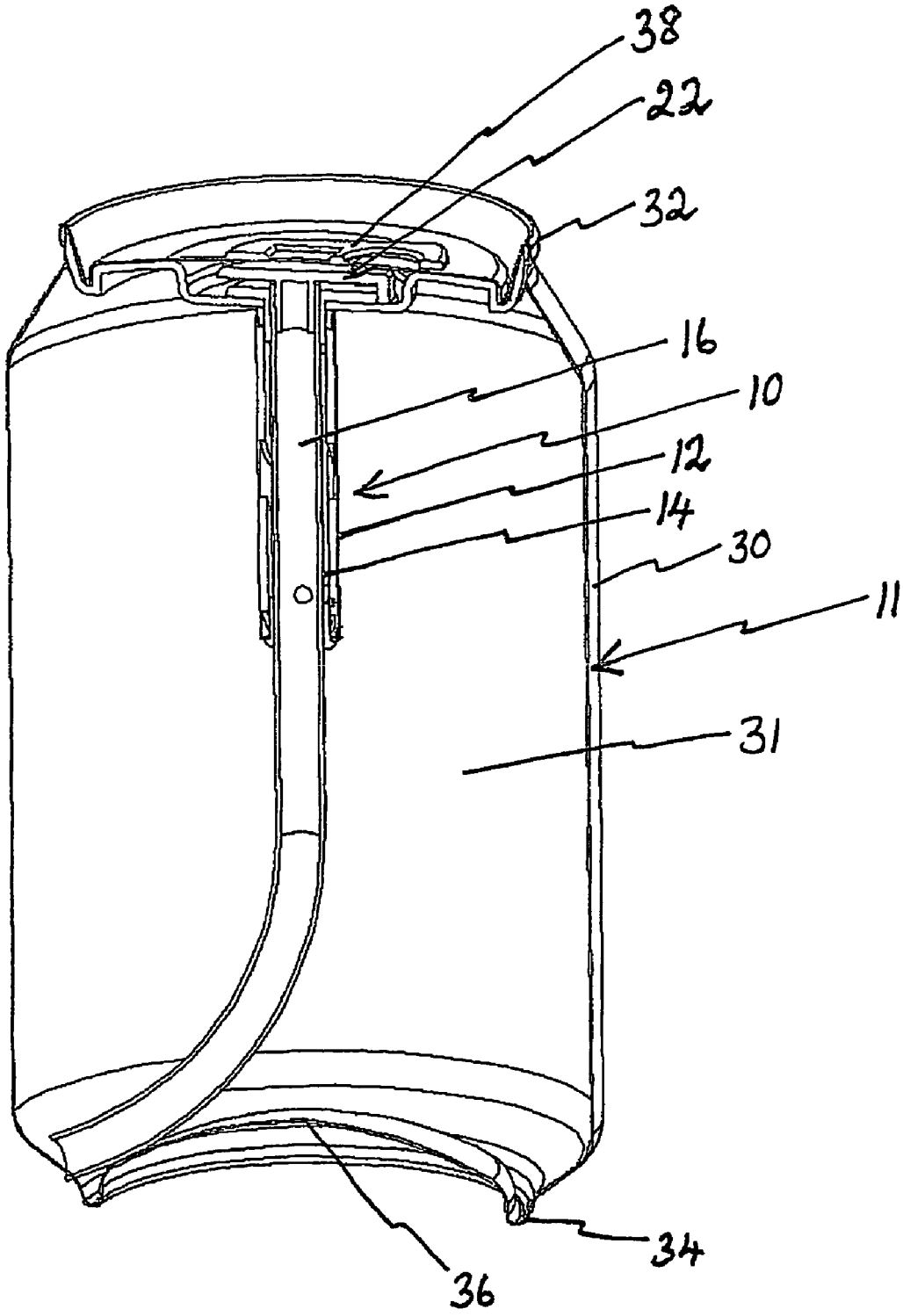
FIG. 1 is a cutaway perspective view of a first embodiment of a device and associated straw, housed substantially within a drinks can, according to the invention.
Figure 2:
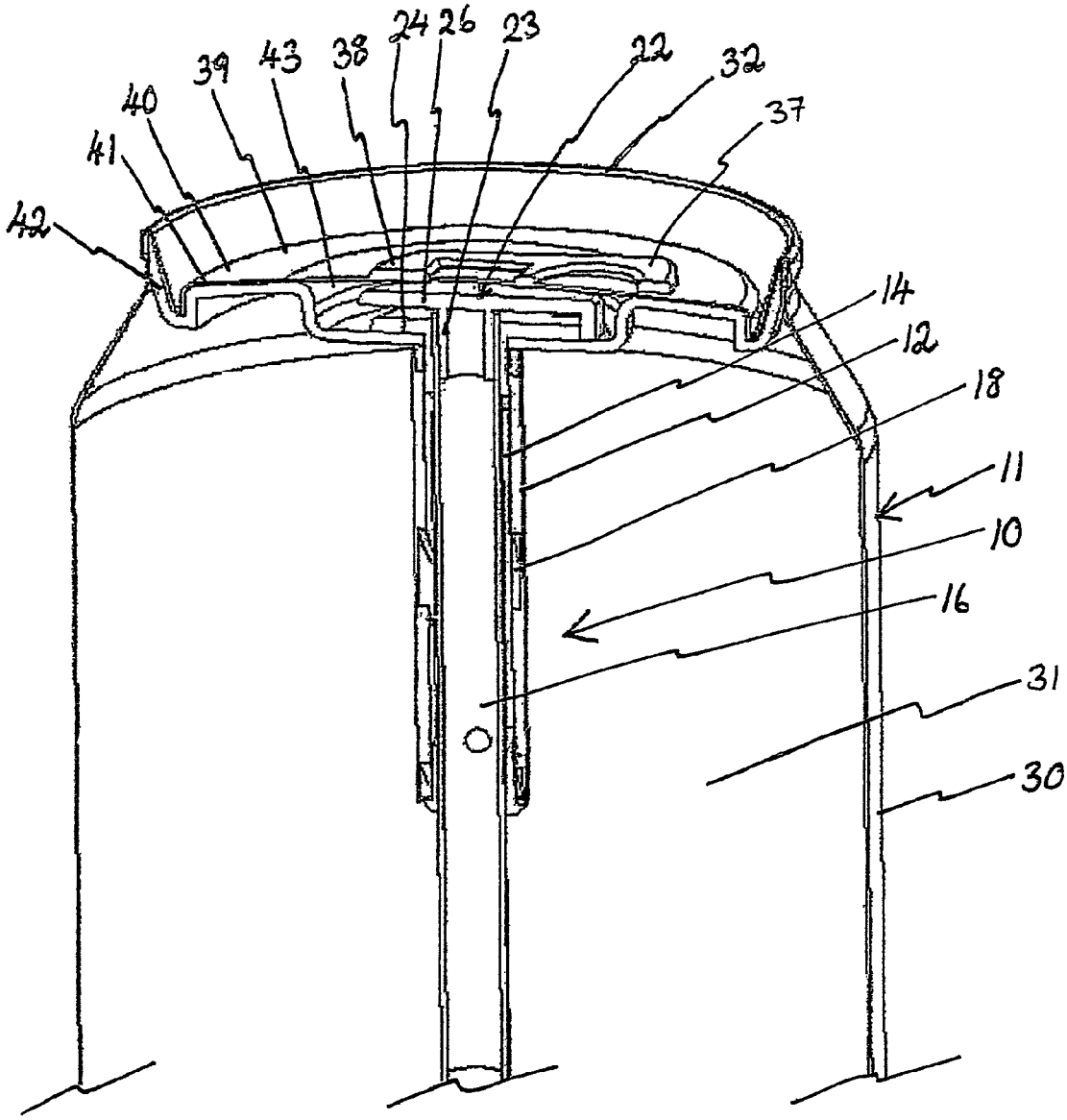
FIG. 2 is an enlarged view of a portion of FIG. 1, wherein the straw is in a first, retracted state within the can.
Figure 3:
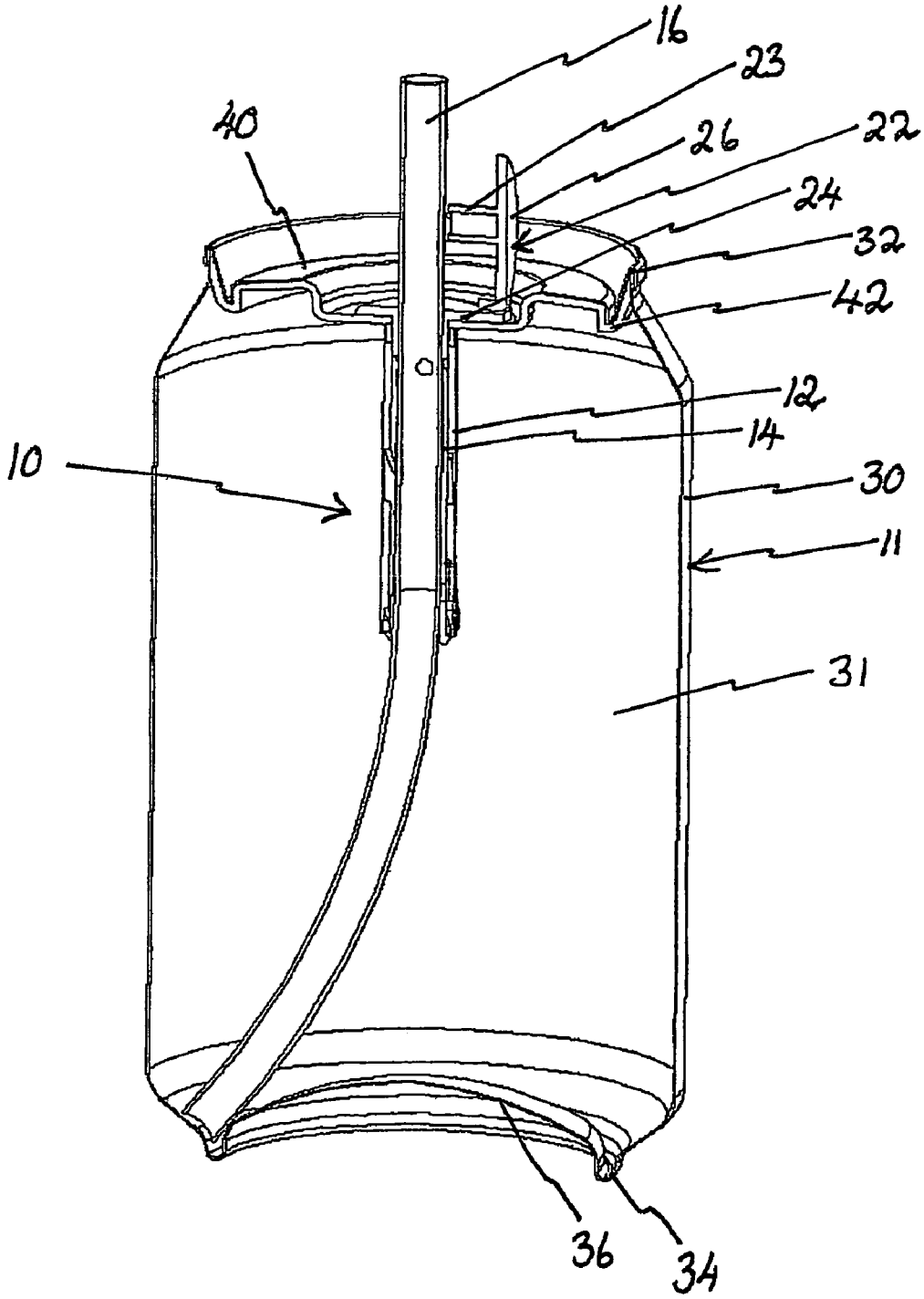
FIG. 3 shows the device and can of FIG. 1, wherein the straw is in a second, extended, state.

Referring now to FIGS. 1 to 3 of the accompanying drawings, there is illustrated a device 10, embodying one aspect of the invention, for use with a drinks container, for example in the form of a can 11. The device 10 comprises, or is capable of receiving, a straw 16, or drinking tube, and includes means for actuating the straw 16 between a retracted state and an extended state. Preferably, the actuating means comprises an actuator which is operable to convert rotary motion into linear motion, in order to effect generally linear extension or retraction of the straw via rotation of the actuator. The actuator preferably comprises first and second generally sleeve-like members or casings 12, 14. The second casing 14 is arranged to fit within the first casing 12 such that the casings 12, 14 are substantially co-axial with one another. In preferred embodiments, the casings 12, 14 may be generally cylindrical in shape. The second casing 14 is arranged to receive the straw 16 such that the straw 16 (or at least the portion of the straw 16 that is contained within the casings 12, 14) is generally co-axial with the casings 12, 14. The straw 16 may, for example, be generally cylindrical in shape. The device 10 is housed substantially within the can 11 such that the straw 16 is moveable between a first, retracted state, wherein the straw 16 is housed substantially within the can, to a second, extended state, wherein at least a portion of the straw 16 protrudes from the can 11, as will be explained in more detail hereinafter. When the device 10 is fitted to the container 30, the casings 12, 14 are located within the container 30.

Referring now to FIGS. 1 and 2 of the drawings, the can 11 may be made of any suitable material, for example aluminium, and is conveniently of any conventional size and shape. In the illustrations, the can 11 comprises a cylindrical side wall 30 bounded by first and second end portions 32, 34, which together define a body or chamber 31 for receiving liquid (not shown). The second end portion 34 is shaped to define a recess 36 which extends inwardly of the body 31. The first end portion 32 may be generally conventional in shape and configuration and includes a platform 40 in which there is provided a ring pull opening mechanism 38.

The ring pull mechanism 38, whose operating tab 37 is provided on a first, or obverse, surface 39 of the platform 40, is operable to produce an aperture (not shown) through the platform 40 of a size large enough to provide access to the device 10.

A layer 42 of material, preferably plastics, is provided adjacent the reverse face or underside 41 of the platform 40. The layer 42 is shaped to define a cavity 43 between the layer 42 and platform 41. In the preferred embodiment, the layer 42 engages with the underside 41 of the platform 40 around its periphery and, around the centre of the platform 40, the layer 42 diverges away from the underside 41 so as to form the cavity 43. The layer 42 is shaped to define an aperture in the cavity 43, through which aperture the straw 16 may pass. The layer 42 may be integrally formed with, or fixed to, the first casing 12 around said aperture so that the aperture serves as the mouth of the casing 12. Hence, the layer 42 may extend into the body 31 of the can 11.

In the preferred embodiment, an end of the second casing 14 is integrally formed with, or otherwise connected to, a first section 24 of a sealing cap 22. The first section 24 may take the form of an annular flange, or collar, shaped and dimensioned to be seated around the aperture formed in the cavity 43. A second section 26 of the cap 22, which comprises a plug 23, may be hingedly connected to the first section 24. The first and second cap sections 24, 26 may be fitted together (as shown in FIGS. 1 and 2) in which state the cap 22 seals the aperture in the cavity 43, or may be detached from one another (as shown in FIG. 3) in which case the aperture in the cavity is open. In the preferred embodiment, when the cap 22 is close, the plug 23, which may be generally cylindrical in shape, sits within an end of the straw 16 when the straw 16 is in the retracted state (as shown in FIGS. 1 and 2). When the straw is in the retracted state, the sealing cap 22 is normally closed and is located in the cavity 43 between the platform 40 and the layer 42. The cap 22 may alternatively be provided on the first casing 12 although it is preferred to provide the cap 22 on the second casing 14 since it may also serve as a handle for rotating the second casing 14.

In the preferred embodiment, the actuating means comprises means for imparting generally linear movement to the straw 16 in response to relative rotational movement between the straw 16 and the first casing 12. Preferably, the imparting means comprises one or more cam surface, typically in the form of a track, groove or edge, and one or more cam followers arranged to follow a cam surface upon relative rotational movement between respective components of the actuating means thereby effecting generally linear actuation of the straw 16 between the retracted and extended states. The, or each, cam surface is conveniently generally helical and the, or each cam follower may comprise, for example, a lug for engagement with a cam surface. In the preferred embodiment, the inner surface of the first casing 12 is shaped to define a cam surface in the form of a threaded portion 18 which extends at least partially along the length thereof, as shown in FIG. 2. Oppositely disposed slots (not shown) are provided along at least part of the length of the second casing 14 (although only one slot is required if only one cam follower is provided). Each slot is preferably provided with a detent (not shown) at each end thereof. One or more cam followers in the form of at least one lug, and preferably a pair of oppositely disposed lugs (not shown) are provided on an outer surface of the straw 16. The arrangement is such that the lugs engage with the cam surface 18 by projecting through the slots in the second casing 14. The lugs conveniently project from the straw in a direction generally perpendicular to the direction of rotation of the straw 16, i.e. generally perpendicular to the longitudinal axis of the straw 16. Hence, rotation of the second casing 14, about its common axis with the first casing 12 and the straw 16, and relative to the first casing 12, causes rotation of the straw 16 which in turn causes the straw 16 to be actuated between the retracted and extended states by interaction of the cam surface and cam followers. In an alternative embodiment (not illustrated) the straw 16 may be fixed with respect to the second casing 14 and the second casing may carry the cam follower(s). Alternatively still, the cam follower(s) may be provided on the inner surface of the first casing 12, the cam surface(s) being provided on the second casing 14, or, where the second casing 14 comprises one or more slots, the cam surface(s) may be provided on the straw 16.

In use, the illustrated embodiment of the device 10 is operable as follows. In the retracted state, the straw 16 is located within the device 10 as shown in FIG. 1 and as described above. The can 11 is opened by pulling the ring pull 38, preferably removing it altogether, giving a user (not shown) access to the sealing cap 22. By pulling on the second section 26, the projection 23 is lifted out of the straw 16. The second section 26 including the projection 23 can then be used as a handle to rotate the first section 24, or collar, and hence the second casing 14 about its longitudinal axis. By rotating the sealing cap 22 in a first direction, typically clockwise, the second casing 14 is rotated relative to the first casing 12 about their substantially common longitudinal axis. The lugs on the straw 16 engage, or ride in, the slots of the second casing 14, and in response to relative rotational movement between the first and second casings 12, 14, the straw 16 is moved to its extended state wherein a portion of the straw 16 protrudes from the can 11. By rotating the sealing cap 22 in an opposite direction, typically anti-clockwise, the straw 16 can be returned to its retracted state. The sealing cap 22 can then be closed to prevent spillage. Thus, in use, the straw 16 is readily moveable between its first, retracted state and its second, extended state, enabling the user to drink the contents (not shown) present in the body 31 of the can 11.

Figure 4:
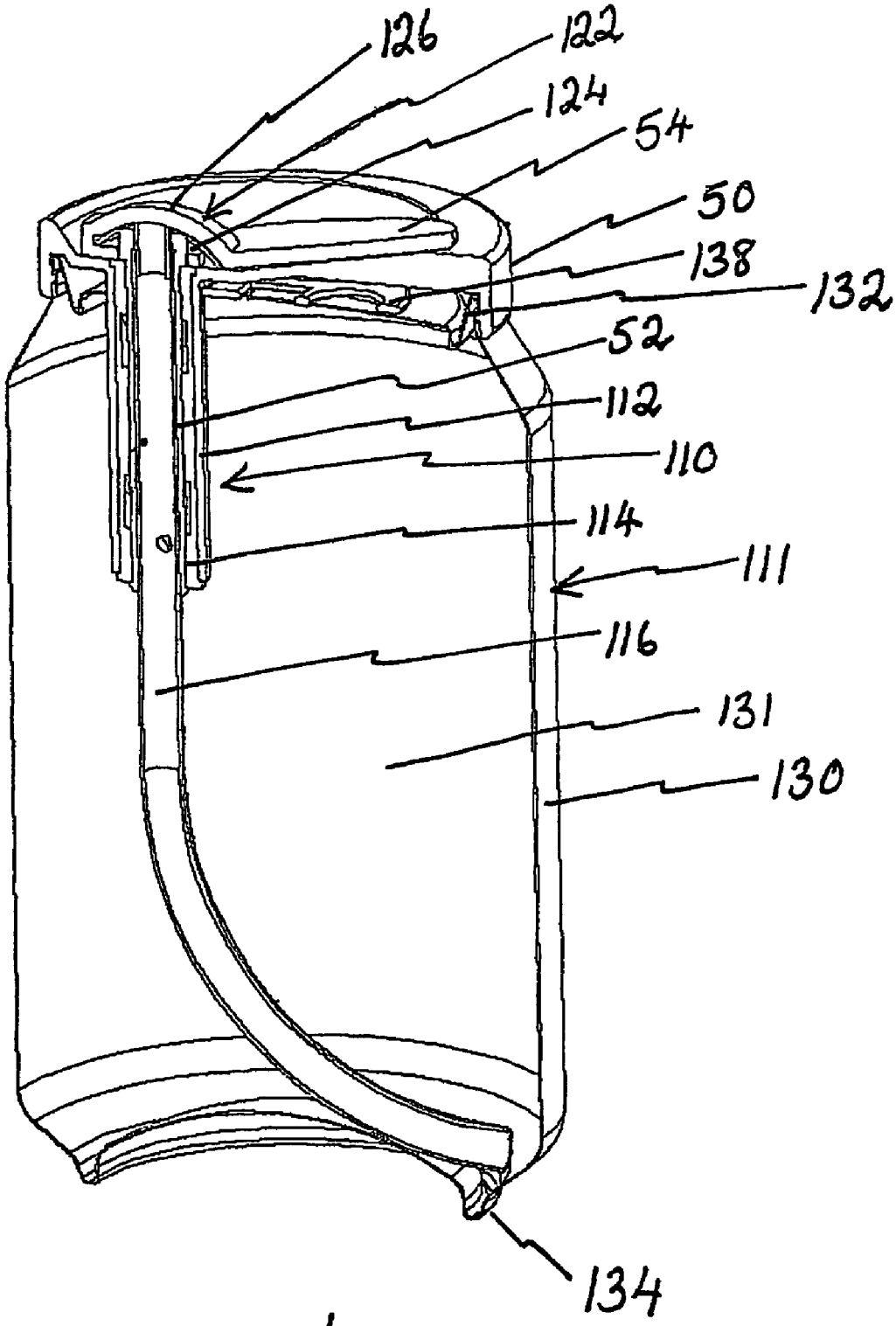
FIG. 4 is a cutaway perspective view of a second embodiment of a device and associated straw, housed substantially within a drinks can, according to the invention, wherein the device includes a lid adapted to co-operate with a first end portion of the can, and the straw is in a first, retracted state.
Figure 5:
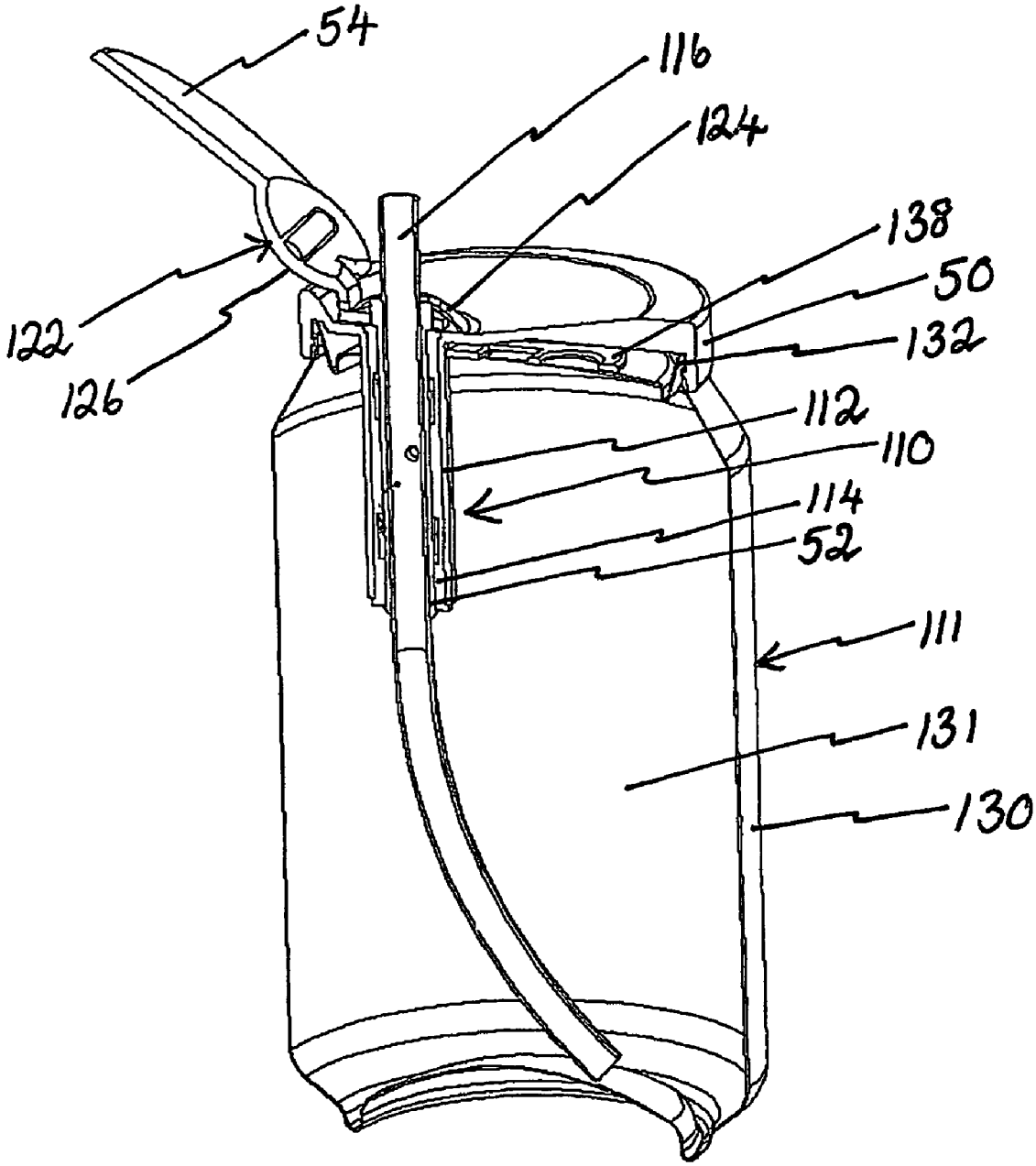
FIG. 5 shows the device and can of FIG. 4, wherein the straw is in a second, extended state.

Referring now to FIGS. 4 and 5, there is illustrated a second embodiment of a device 110, in which like features of the invention have been accorded like numerals, and in which the device 110 is seated in the mouth of the container 130.

The first and second casings 112, 114 are similar to the casings 12, 14 of the first embodiment except for the following differences. The first casing 112 is not integrally formed with any plastic layer 42. Instead, the otherwise free end of the first casing 112 is integrally formed with, or otherwise fixed to or mountable on, a cap or lid 50. The lid 50 is preferably adapted for snap-fit engagement with the first end 132 of the can 111 (or other container). When the lid is fitted to a container, the device 110 is seated in the mouth of the container. The device 110 is particularly suitable for use as a retro-fit device 110 with a conventional drinks can, as described below.

The sealing cap 122 of the second embodiment may have a different shape to that of the first embodiment, as shown in FIG. 4. The sealing cap 122 includes a second section 126, which is preferably dome-shaped and which preferably is hingedly attached to the first section 124, which is also preferably dome-shaped. The sealing cap 122 is conveniently attached to, or co-formed with, the second casing 114 as hereinbefore described. The second section 126 preferably includes an elongate portion in the form of a handle 54, used for retracting and extending the straw 116 by rotating the sealing cap 122, as hereinbefore described. The handle 54 preferably lies substantially flush against the lid 50 when the cap 122 is closed (and the straw 116 is in the first state). Preferably, the device 110 substantially fills the aperture created by opening the ring pull 138 to prevent spillage of liquid from around the periphery of the device 110. As with other embodiments, the straw, when the device is fitted to a drinks container, provides access to the contents of the container.

The device 110 may also, optionally, be provided with a third sleeve-like casing 52 located between, and being generally co-axial with, the straw 116 and the second casing 114. The third casing 52 may simply enable the device 110 to have a width necessary to provide a secure fit within the aperture of the can 111. The third casing 52 is preferably shaped and dimensioned in the same way as the second casing 114, so that the third casing 52 essentially works in the same way as the second casing 114.

The device 110 may conveniently be used as follows. Once the ring pull 138 of a conventional can has been opened, or, preferably, removed, thereby creating an aperture in a normal way, the device 110 (including the first and second casings 112, 114, the straw 116 and optionally the third casing 52) is inserted into the can 111. The lid 50 engages by a snap-fit arrangement with the first end 132 of the can as shown in FIG. 4. Thus, once the device 110 is inserted into the can 111, the sealing cap 122 can be closed, retaining the straw 116 in the retracted state, or the sealing cap 122 can be opened, and the straw 116 extended, as shown in FIG. 5. The device 110 therefore conveniently provides means of re-closing and further re-opening a conventional can which has already been opened.

Figure 6:
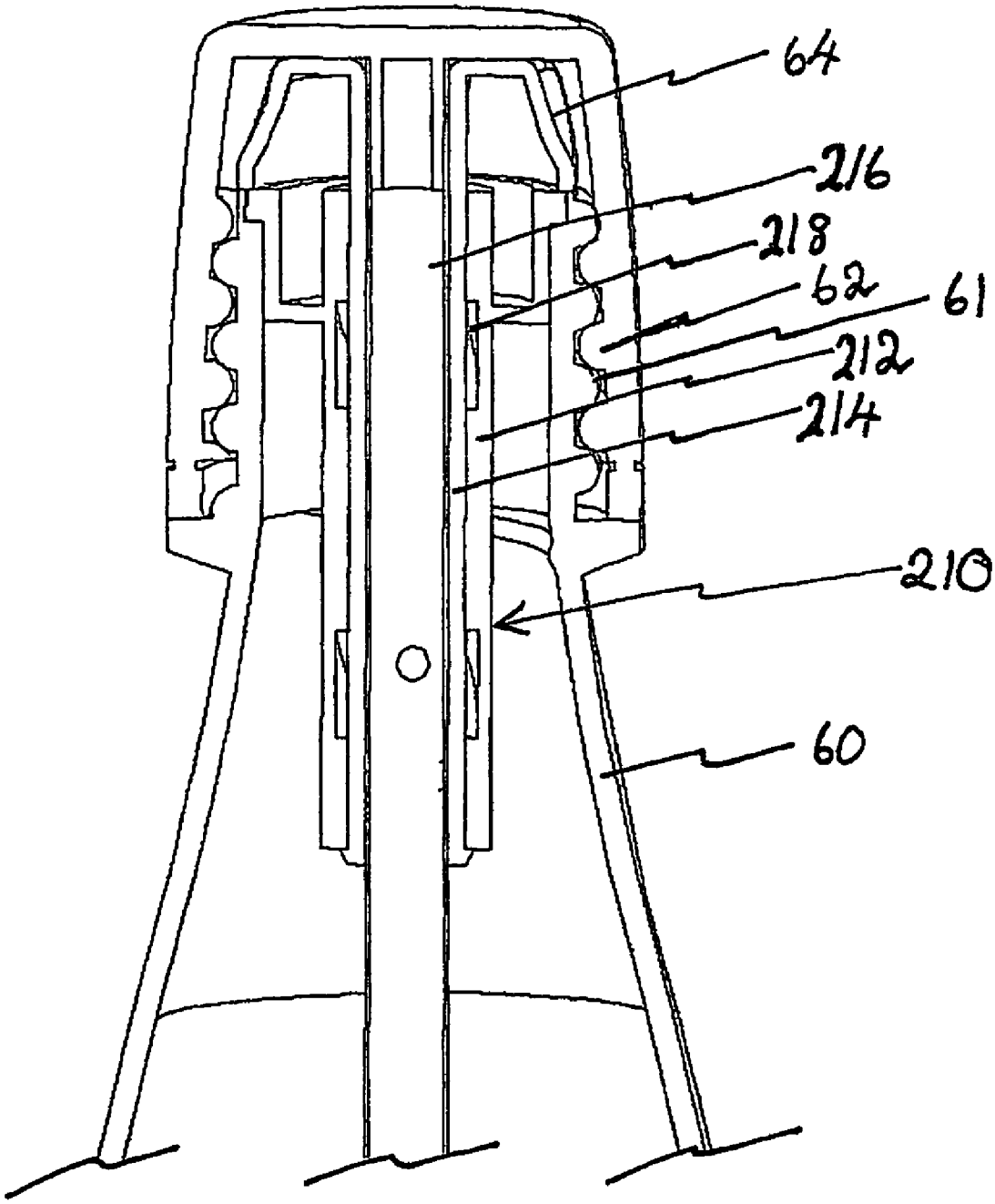
FIG. 6 is a cutaway perspective view of a portion of a third embodiment of a device for use with a drinks bottle, only a portion of the bottle being shown, according to the invention, the device including a removable screw-threaded bottle top, and wherein, the straw is in a first, retracted state.
Figure 7:
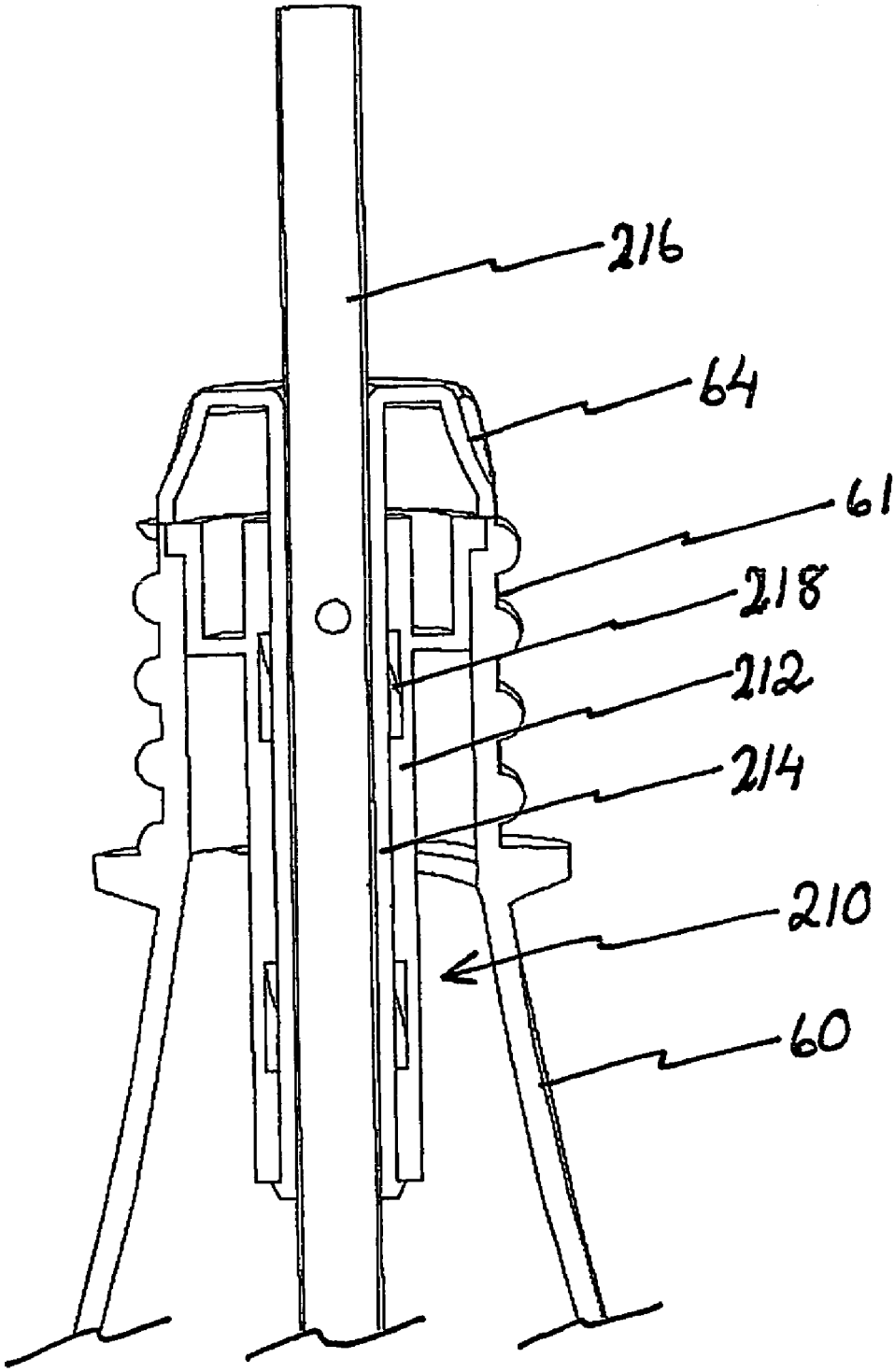
FIG. 7 shows the device and bottle of FIG. 6 wherein the bottle top is removed, and the straw is in a second, extended state.

Referring now to FIGS. 6 and 7, there is illustrated a third embodiment of a device 210, in which like features of the invention have been accorded like numerals. The device 210 is adapted to fit a bottle 60. FIG. 6 shows the device 210 housed within a bottle 60. As hereinbefore described, the device 210 includes first and second casings 212, 214. The neck 61 of the bottle 60 is threaded to co-operate with an outer screw-threaded bottle top 62.

The first casing 212 is adapted to fit securely within the neck 61, as shown in FIG. 6. The otherwise free end of the second casing 214 projects beyond the first casing 214 and preferably beyond the neck 61 so that it may be grasped and rotated by a user. Preferably, the end of the second casing is shaped so as to facilitate gripping by a user and may, for example, take the form of an annulus. In FIGS. 6 and 7, the end of the second casing is generally U-shaped in section, and extends out of the opening of the bottle 60 so as to form an inner rotatable bottle top 64.

In use, the user unscrews and removes the outer bottle top 62. By rotating the inner bottle top 64, the straw 216 may be retracted and extended as hereinbefore described.

In each of the preferred embodiments described herein, the device 10, 110, 210 is arranged to retain the straw 16, 116, 216 in the retracted state or the extended state or any of the infinite intermediate states in which the straw may be said to be only partially extended or retracted. The actuating means engages with the straw 16, 116, 216 and holds the straw 16, 116, 216 relative to the container 30, 130, 60. Hence, the straw 16, 116, 216 does not move under its own weight or under any resilient bias that may be created between the straw 16, 116, 216 and the internal surface of the container 30, 130, 60.

In each of the preferred embodiments, the container comprises an aperture or mouth in which the device 10, 110, 210 is seated during use and through which the straw 16, 116, 216 can pass to allow access to the contents of the container. The mouth may comprise an existing container mouth (see for example the embodiments of FIGS. 4 to 7).

The present invention is not limited to the embodiments described herein. For example, the straw 16; 116; 216 is not limited to being retracted and extended by rotating the second casing 14; 114; 214 in a clockwise/anti-clockwise direction. The relative movement between the first and second casings 12; 112; 212, 14; 114; 214 may alternatively be effected in any other way. Alternatively, the device 10; 110; 210 may be simplified further whereby the straw 16; 116; 216 may simply be manually pulled out of the drinks container 111; 60 in order to move into its extended state. In yet an alternative embodiment, the second casing 14, 114, 214 may be omitted and movement of the straw between the extended and retracted states may be effected by rotation of the straw itself. To this end, the straw may be provided with a handle which may be grasped by a user even when the straw is in the retracted state. In such an embodiment, where the cam surface comprises a threaded portion, the cam follower may comprise a correspondingly threaded portion.

The present invention is not limited to the embodiments described herein which may be amended or modified without departing from the scope of the present invention.

The invention claimed is:

1. A device for a drinks container, the device comprising a straw and means for actuating the straw between a retracted state, in which the straw is housed, in use, substantially within the container, and an extended state, in which at least a portion of the straw projects, in use, from the container:

wherein the actuating means comprises a first casing provided around a portion of the straw, the straw and the casing being rotatable with respect to one another about a longitudinal axis, the actuating means further comprising means for imparting generally linear movement to the straw upon relative rotational movement of the casing and straw portion;

wherein one of the casing and the straw portion is associated with one or more cam surfaces, the other of the casing and the straw portion being associated with one or more cam followers;

wherein the actuating means includes a second casing provided around said portion of the straw and between said straw portion and said first casing, the first and second casings being rotatable with respect to one another about a longitudinal axis, the second casing being shaped to define a slot in which the or each cam follower rides.

2. A device as claimed in claim 1, wherein the second casing includes a handle portion which projects beyond the first casing in the general direction in which the straw is movable towards the extended state.

3. A device as claimed in claim 2, wherein said handle portion comprises a cap for blocking the straw when in the retracted state.

4. A device as claimed in claim 2, wherein the lid is adapated for press-fit engagement with the end of the container that includes the container mouth.

5. A device as claimed in claim 1, wherein the straw carries one or more cam followers in the form of one or more lugs and the first casing comprises one or more cam surfaces in the form of a generally helical track.

6. A device as claimed in claim 1, the device being carried by a lid for the container, the arrangement being such that, when the lid if fitted to the container, the device is seated in the mouth of the container.

7. A container comprising a device as claimed in claim 1.

* * * * *